US010186810B2

(12) United States Patent
Morgan et al.

(10) Patent No.: US 10,186,810 B2
(45) Date of Patent: Jan. 22, 2019

(54) SHIELDING STRUCTURE FOR A CONTACT MODULE

(71) Applicants: TE CONNECTIVITY CORPORATION, Berwyn, PA (US); TYCO ELECTRONICS JAPAN G.K., Kawasaki-shi (JP)

(72) Inventors: Chad William Morgan, Carneys Point, NJ (US); John Joseph Consoli, Harrisburg, PA (US); Yoshihiko Kodaira, Fujisawa (JP); Hiroshi Shirai, Tokorozawa (JP); Masayuki Aizawa, Machida (JP)

(73) Assignees: TE CONNECTIVITY CORPORATION, Berwyn, PA (US); TYCO ELECTRONICS JAPAN G.K., Kawasaki-shi (JP)

( * ) Notice: Subject to any disclaimer, the term of this patent is extended or adjusted under 35 U.S.C. 154(b) by 0 days.

(21) Appl. No.: 15/417,351

(22) Filed: Jan. 27, 2017

(65) Prior Publication Data

US 2018/0219330 A1 Aug. 2, 2018

(51) Int. Cl.

| | |
|---|---|
| ***H01R 13/6586*** | (2011.01) |
| ***H01R 13/6587*** | (2011.01) |
| *H01R 12/72* | (2011.01) |
| *H01R 13/514* | (2006.01) |

(52) U.S. Cl.

CPC ..... *H01R 13/6587* (2013.01); *H01R 12/724* (2013.01); *H01R 13/514* (2013.01); *H01R 13/6586* (2013.01)

(58) Field of Classification Search

CPC ..... H01R 13/6586; H01R 13/6587
USPC ..... 439/607.06
See application file for complete search history.

(56) References Cited

U.S. PATENT DOCUMENTS

| | | | | |
|---|---|---|---|---|
| 6,843,687 | B2 | 1/2005 | McGowan et al. | |
| 8,183,466 | B2 | 5/2012 | Morlion et al. | |
| 8,398,431 | B1 * | 3/2013 | Whiteman, Jr. ... | H01R 13/6587 439/607.06 |
| 8,398,434 | B2 | 3/2013 | Davis et al. | |
| 8,444,434 | B2 | 5/2013 | Davis et al. | |
| 8,579,636 | B2 | 11/2013 | Davis et al. | |
| 8,591,260 | B2 | 11/2013 | Davis et al. | |
| 8,690,604 | B2 * | 4/2014 | Davis ..... | H01R 23/688 439/607.07 |
| 8,771,017 | B2 | 7/2014 | Vino, IV et al. | |
| 8,777,663 | B2 | 7/2014 | Annis et al. | |
| 8,992,252 | B2 | 3/2015 | McClellan et al. | |
| 9,331,407 | B2 | 5/2016 | Laurx et al. | |
| 2016/0181732 | A1 | 6/2016 | Laurx et al. | |

* cited by examiner

*Primary Examiner* — Abdullah Riyami
*Assistant Examiner* — Justin Kratt

(57) ABSTRACT

A contact module includes a dielectric holder having right and left sides holding signal contacts. A shield structure is coupled to the dielectric holder providing electrical shielding for the signal contacts. The shield structure has a first ground shield provided at the right side of the dielectric holder and a second ground shield provided at the left side of the dielectric holder. The first and second ground shields are electrically connected together between corresponding pairs of the signal contacts and providing electrical shielding between corresponding signal contacts along a majority of a length of the transition portions.

20 Claims, 7 Drawing Sheets

SHIELDING STRUCTURE FOR A CONTACT MODULE

BACKGROUND OF THE INVENTION

The subject matter herein relates generally to shielding structures for contact modules of electrical connectors.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, while the ground shield(s) may provide shielding along the sides of the signal conductors, known electrical connectors do not provide sufficient additional electrical shielding above and/or below the signal conductors throughout the length of the contact modules. For example, the additional electrical shielding may only be provided at the mating interface with the mating electrical connector and not along the length of the signal conductors between the mating end and the mounting end mounted to the circuit board.

Furthermore, for contact modules that provide pairs of signal conductors arranged in the same row, rather than the same column, shielding between the pairs of signal conductors is difficult and/or expensive. For example, some known electrical connectors provide contact modules with conductive shells that provide some additional shielding. However, the shells are plated plastic or die cast shells that can add significant cost to the contact modules.

A need remains for a shielding structure for contact modules along significant lengths of the signal contacts thereof to provide electrical shielding between pairs of the signal contacts.

BRIEF DESCRIPTION OF THE INVENTION

In one embodiment, a contact module is provided including a dielectric holder having right and left sides extending between a mating end and a mounting end and signal contacts being held by the dielectric holder. The signal contacts have mating portions extending from the mating end, mounting portions extending from the mounting end for termination to a circuit board, and transition portions extending through the dielectric holder between the mating and mounting portions. A shield structure is coupled to the dielectric holder providing electrical shielding for the signal contacts. The shield structure has a first ground shield provided at the right side of the dielectric holder and a second ground shield provided at the left side of the dielectric holder. The first and second ground shields are electrically connected together between corresponding signal contacts and providing electrical shielding between corresponding signal contacts along a majority of a length of the transition portions.

In another embodiment, a shield structure for a contact module is provided having a dielectric holder holding signal contacts. The shield structure includes a first ground shield and a second ground shield. The first ground shield is configured to extend along a right side of the dielectric holder. The first ground shield has a main body having a plurality of right side rails separated by right side gaps. The right side rails have side strips configured to extend along the right side of the dielectric holder and separator strips configured to extend into the dielectric holder and extend between corresponding signal contacts. The second ground shield extends along a left side of the dielectric holder. The second ground shield has a main body having a plurality of left side rails separated by left side gaps. The left side rails have side strips configured to extend along the left side of the dielectric holder and separator strips configured to extend into the dielectric holder and extend between corresponding signal contacts. The separator strips of the right side rails engage and are electrically connected to corresponding separator strips of the left side rails. The side strips of the right side rails are aligned with corresponding side strips of the left side rails on opposite sides of the corresponding signal contacts and the gaps between the side strips are offset at least one of above and below the corresponding signal contacts.

In a further embodiment, an electrical connector is provided including a housing having a mating end and a back end opposite the mating end and contact modules arranged in a contact module stack received in and extending from the back end of the housing for termination to a circuit board. Each contact module includes a dielectric holder having right and left sides extending between a mating end and a mounting end and signal contacts being held by the dielectric holder. The signal contacts have mating portions extending from the mating end, mounting portions extending from the mounting end for termination to a circuit board, and transition portions extending through the dielectric holder between the mating and mounting portions. A shield structure is coupled to the dielectric holder providing electrical shielding for the signal contacts. The shield structure has a first ground shield provided at the right side of the dielectric holder and a second ground shield provided at the left side of the dielectric holder. The first and second ground shields are electrically connected together between corresponding signal contacts and providing electrical shielding between corresponding signal contacts along a majority of a length of the transition portions.

DETAILED DESCRIPTION OF THE INVENTION

Figure 1:
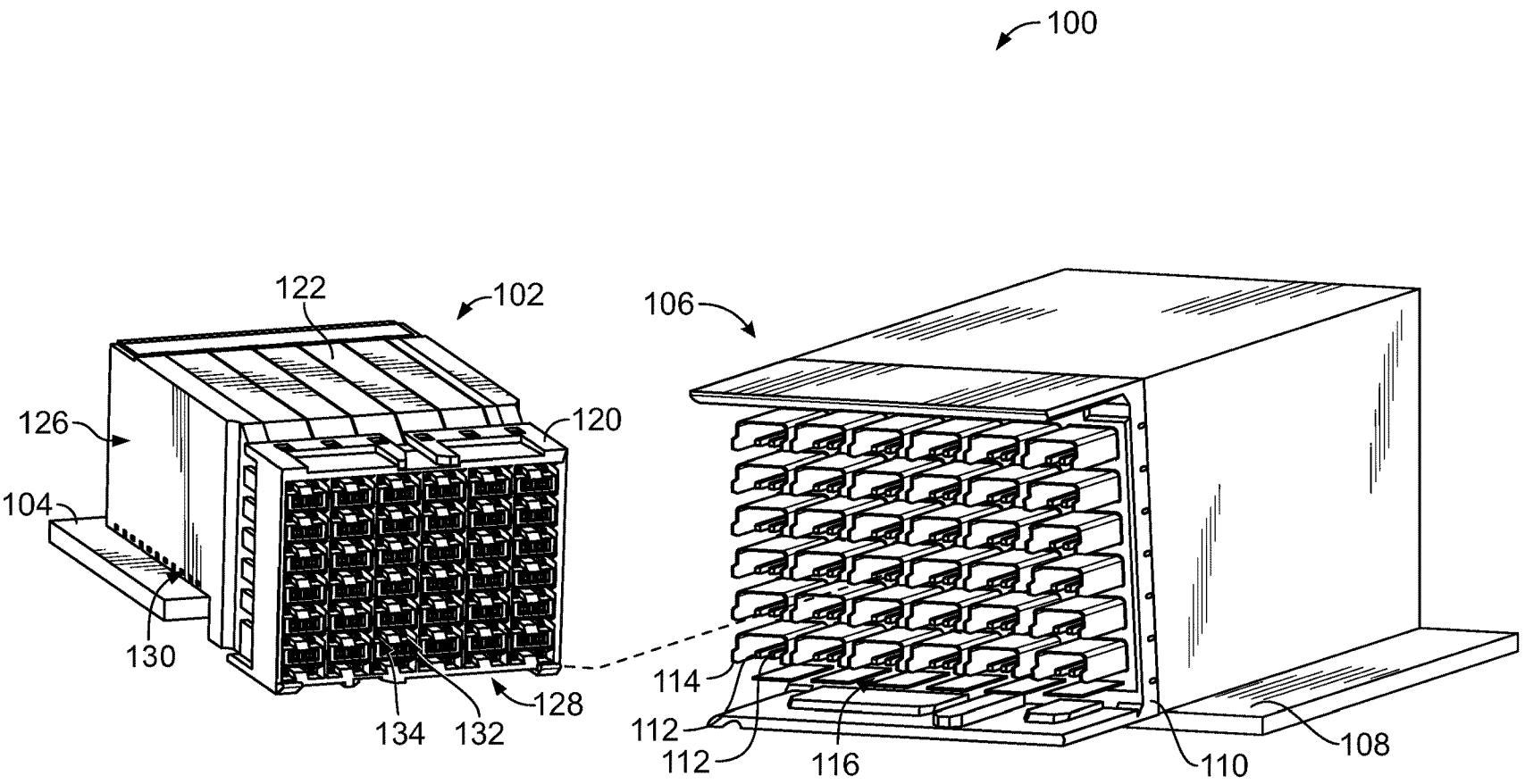
FIG. 1 is a front perspective view of an electrical connector system having an electrical connector formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104 and a mating electrical connector 106, which may be mounted to a circuit board 108. The mating electrical connector 106 may be a header connector. Various types of connector assemblies may be used in various embodiments, such as a right angle connector, a vertical connector or another type of connector.

The mating electrical connector 106 includes a housing 110 holding a plurality of mating signal contacts 112 and mating ground shields 114. The mating signal contacts 112 may be arranged in pairs 116. Each mating ground shield 114 extends around corresponding mating signal contacts 112, such as the pairs 116 of mating signal contacts 112. In the illustrated embodiment, the mating ground shields 114 are C-shaped having three walls extending along both sides and the top of each pair of mating signal contacts 112. The mating ground shield 114 below the pair 116 provides electrical shielding across the bottom of the pair 116. As such, the pairs 116 of mating signal contacts 112 are circumferentially surrounded on all four sides by the mating ground shields 114.

The electrical connector 102 includes a housing 120 that holds a plurality of contact modules 122. The contact modules 122 are held in a stacked configuration generally parallel to one another. The contact modules 122 may be loaded into a rear end of the housing 120 side-by-side in the stacked configuration as a unit or group. Any number of contact modules 122 may be provided in the electrical connector 102. The contact modules 122 each include a plurality of signal contacts 124 (shown in FIG. 2) that define signal paths through the electrical connector 102. The signal contacts 124 are configured to be electrically connected to corresponding mating signal contacts 112 of the mating electrical connector 106.

The electrical connector 102 includes a mating end 128, such as at a front of the electrical connector 102, and a mounting end 130, such as at a bottom of the electrical connector 102. In the illustrated embodiment, the mounting end 130 is oriented substantially perpendicular to the mating end 128. The mating and mounting ends 128, 130 may be at different locations other than the front and bottom in alternative embodiments. The signal contacts 124 extend through the electrical connector 102 from the mating end 128 to the mounting end 130 for mounting to the circuit board 104.

The signal contacts 124 are received in the housing 120 and held therein at the mating end 128 for electrical termination to the mating electrical connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single ended applications. Optionally, the pairs of signal contacts 124 may be arranged in rows (pair-in-row signal contacts). The signal contacts 124 within each pair may be contained within the same contact module 122.

In an exemplary embodiment, each contact module 122 has a shield structure 126 for providing electrical shielding for the signal contacts 124. The shield structure is configured to be electrically connected to the mating ground shields 114 of the mating electrical connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the mating electrical connector and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts 112 of the mating electrical connector 106. In the illustrated embodiment, the ground contact openings 134 are C-shaped extending along both sides and the tops of the corresponding pair of signal contact openings 132. The ground contact openings 134 receive mating ground shields 114 of the mating electrical connector 106 therein. The ground contact openings 134 also receive portions of the shield structure 126 (for example, beams and/or fingers) of the contact modules 122 that mate with the mating ground shields 114 to electrically common the shield structure 126 with the mating electrical connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

Figure 2:
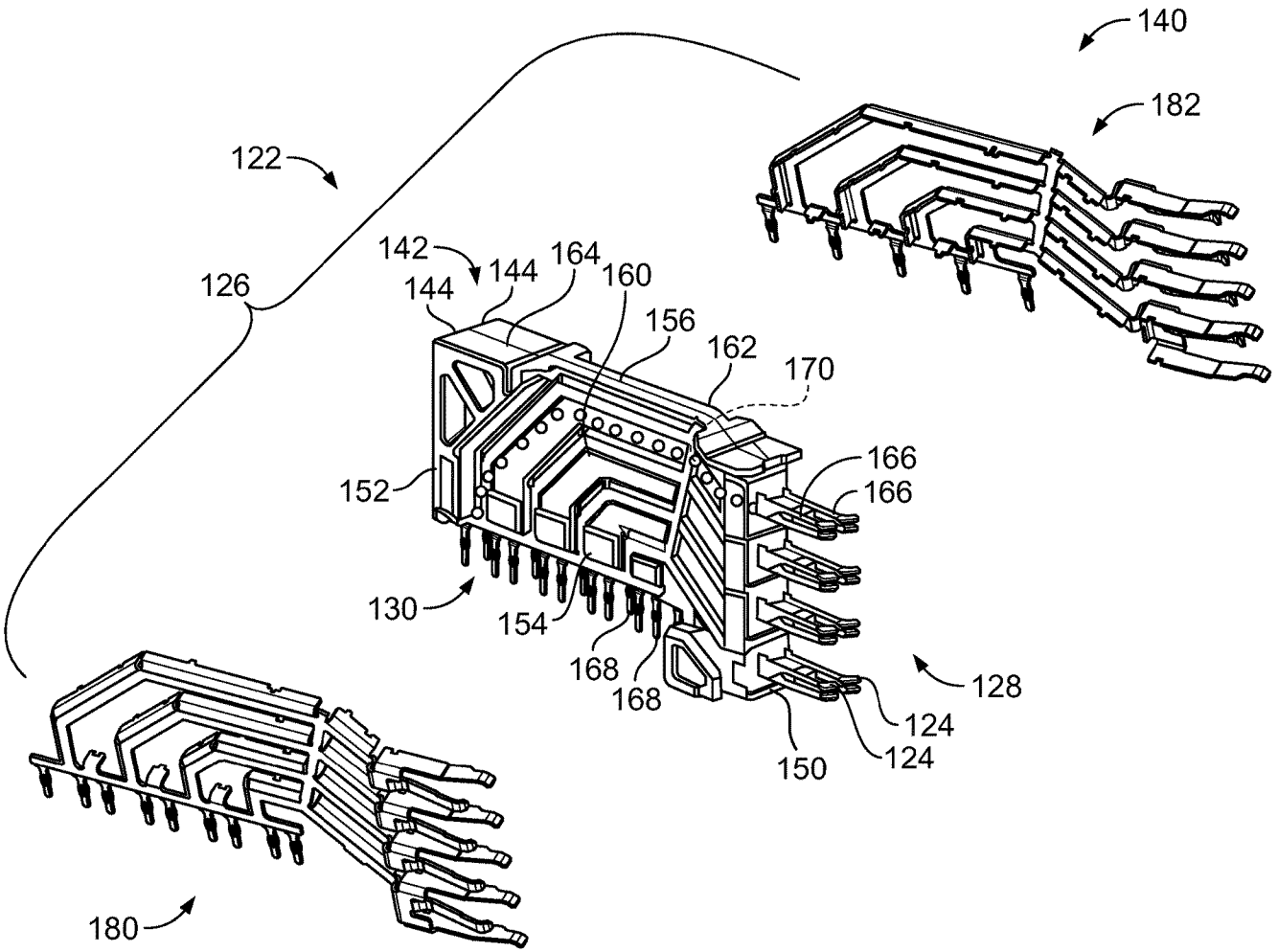
FIG. 2 is an exploded view of a contact module of the electrical connector in accordance with an exemplary embodiment.
Figure 3:
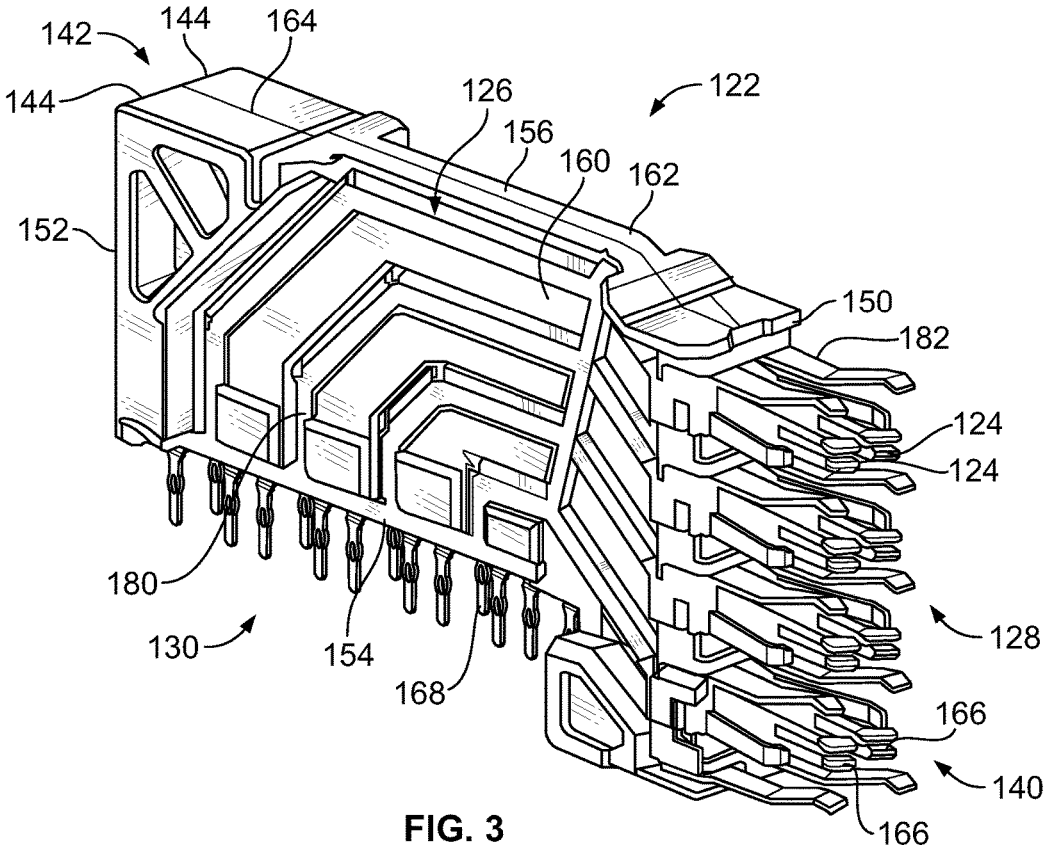
FIG. 3 is an assembled view of the contact module.

FIG. 2 is an exploded view of one of the contact modules 122 in accordance with an exemplary embodiment. FIG. 3 is an assembled view of the contact module 122. The contact module 122 includes a frame assembly 140 having an array of the signal contacts 124 and a dielectric holder 142 holding the signal contacts 124. The dielectric holder 142 generally surrounds the signal contacts 124 along substantially the entire length of the signal contacts 124 between the mounting end 130 at the bottom and the mating end 128 at the front. The shield structure 126 is coupled to the dielectric holder 142 to provide electrical shielding for the signal contacts 124, such as for each pair of the signal contacts 124. The shield structure 126 provides circumferential shielding for each pair of signal contacts 124 along at least a majority of a length of the signal contacts 124, such as substantially an entire length of the signal contacts 124.

In an exemplary embodiment, the frame assembly 140 is assembled together from two contact sub-assemblies. For example, the dielectric holder 142 may be a two-piece holder formed from two dielectric bodies 144 arranged back-to-back. Each dielectric body 144 surrounds a corresponding array of signal contacts 124. The dielectric body 144 may be overmolded over the signal contacts 124 (for example, each dielectric body 144 may be overmolded over a set of the signal contacts 124 to form the contact sub-assemblies). Optionally, the signal contacts 124 may be initially formed from a leadframe and overmolded by the corresponding dielectric body 144 such that portions of the signal contacts 124 are encased in the dielectric holder 142.

The dielectric holder 142 has a front 150 configured to be loaded into the housing 120 (shown in FIG. 1), a rear 152 opposite the front 150, a bottom 154 which optionally may be adjacent to the circuit board 104 (shown in FIG. 1), and a top 156 generally opposite the bottom 154. The dielectric holder 142 also includes a right side 160 and a left side 162. The shield structure 126 is coupled to both the right and left sides 160, 162. The dielectric bodies 144 include respective interior sides 164 facing and abutting each other. Each dielectric body 144 holds one of the signal contacts 124 from each pair such that the pair has signal contacts 124 in both contact sub-assemblies. When assembled, the signal contacts 124 in each pair are aligned with each other and follow similar paths between the mating and mounting ends 128, 130. For example, the signal contacts 124 have similar shapes and thus have similar lengths, which reduces or eliminates skew in the signal paths for the pairs. The pair-in-row arrangement may enhance the electrical performance of the contact module 122 as compared to pair-in-column contact modules having the signal contacts of each pair radially offset from each other (for example, one radially inside and the other radially outside), leading to skew problems.

The signal contacts 124 may be stamped and formed from a sheet of metal material. Each signal contact 124 has a mating portion 166 extending forward from the front 150 of the conductive holder 144 and a mounting portion 168 extending downward from the bottom 154. Each signal contact 124 has a transition portion 170 (one of which is shown in phantom in FIG. 2) between the mating and mounting portions 166, 168. The transition portions 170 each include a top, a bottom, a right side, and a left side. In an exemplary embodiment, the top, bottom, and corresponding outer side are each configured to be shielded by the shield structure 126. The mating portions 166 are configured to be electrically terminated to corresponding mating signal contacts 112 (shown in FIG. 1) when the electrical connector 102 is mated to the mating electrical connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes first and second ground shields 180, 182. The ground shields 180, 182 cooperate to provide circumferential shielding for each pair of signal contacts 124 along the length thereof. The first ground shield 180 is positioned along the right side 160 of the dielectric holder 142, and as such, may be hereinafter referred to as the right ground shield 180. The second ground shield 182 is positioned along the left side 162 of the dielectric holder 142, and may be hereinafter referred to as the left ground shield 182. The ground shields 180, 182 electrically connect the contact module 122 to the mating electrical connector 106, such as to the mating ground shields 114 thereof (shown in FIG. 1), thereby electrically commoning the connection between the electrical connector 102 and the mating electrical connector. The ground shields 180, 182 electrically connect the contact module 122 to the circuit board 104, such as through compliant pins thereof. The ground shields 180, 182 may be similar and include similar features and components. As such, the description below may include description of either ground shield, which may be relevant to the other ground shield, and like components may be identified with like reference numerals.

Figure 4:
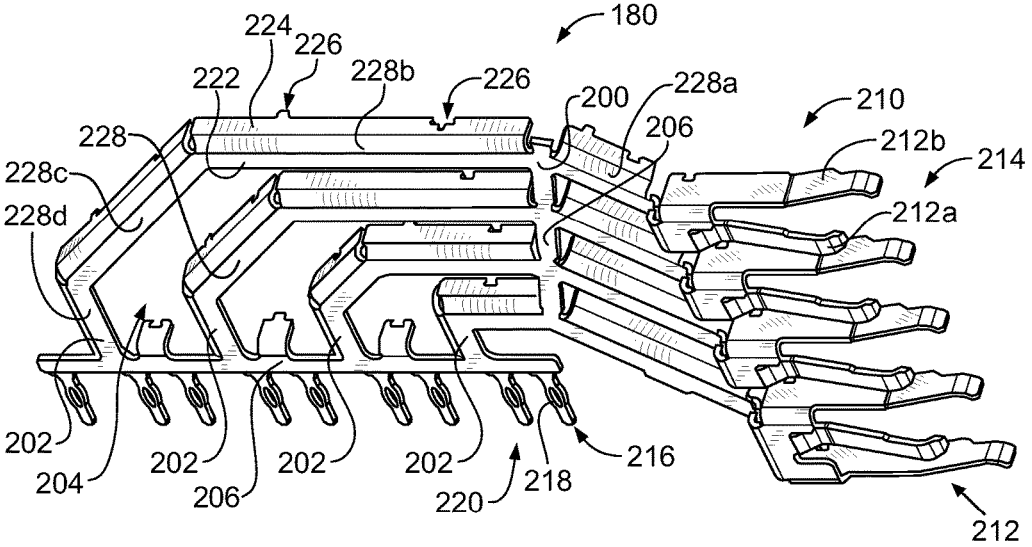
FIG. 4 is a perspective view of a first ground shield of the contact module in accordance with an exemplary embodiment.

FIG. 4 is a perspective view of the first ground shield 180 in accordance with an exemplary embodiment. In an exemplary embodiment, the ground shield 180 is stamped and formed from a stock piece of metal material. The ground shield 180 includes a main body 200 configured to extend along the right side 160 of the dielectric holder 142 (both shown in FIG. 2). The main body 200 may include a plurality of right side rails 202 separated by right side gaps 204, which may be interconnected by connecting strips 206 between the rails 202.

The ground shield 180 includes mating portions 210 defined by mating beams 212 at a mating end 214 of the main body 200. The mating portions 210 are configured to be mated with corresponding mating portions of the mating electrical connector 106 (for example, the C-shaped mating ground shields 114, shown in FIG. 1). In an exemplary embodiment, the ground shield 180 includes side mating beams 212*a* and top mating beams 212*b* configured to extend along the sides and the tops of the corresponding signal contacts 124. The mating beams 212 may be deflectable mating beams, such as spring beams. Optionally, the mating beams 212 are configured to be received inside the corresponding C-shaped mating ground shields 114 of the mating electrical connector 106. Alternatively, the mating beams 212 are configured to extend along the outside of the corresponding C-shaped mating ground shields 114 of the mating electrical connector.

The ground shield 180 includes mounting portions 216 defined by compliant pins 218 at a mounting end 220 of the main body 200. The mounting portions 216 are configured to be terminated to the circuit board 104 (shown in FIG. 1). For example, the mounting portions 216 are configured to be received in plated vias in the circuit board 104.

The right side rails 202 are configured to provide shielding around corresponding signal contacts 124 (shown in FIG. 2). For example, in an exemplary embodiment, the right side rails 202 have side strips 222 configured to extend along the right side 160 of the dielectric holder 142 and separator strips 224 configured to extend into the dielectric holder 142 and extend between corresponding signal contacts 124. The separator strips 224 are bent perpendicular to and extend from the corresponding side strips 222. The right side rails 202 form right angle shielded spaces that receive corresponding signal contacts 124 to provide electrical shielding along the sides of the signal contacts 124 and between the signal contacts 124, such as above and/or below corresponding signal contacts 124. The connecting strips 206 extend between the right side rails 202 to hold the relative positions of the right side rails 202. The right side gaps 204 are defined between the connecting strips 206 and generally follow the paths of the right side rails 202.

In an exemplary embodiment, each separator strip 224 includes a commoning feature 226 for electrically connecting to the second ground shield 182 (shown in FIG. 2). In the illustrated embodiment, the commoning features 226 are commoning tabs that extend outward from the separator strips 224 and commoning slots formed in the separator strips 224; however, only one type of commoning feature may be used or other types of commoning features may be used in alternative embodiments, such as slots, spring beams, and the like. The commoning features 226 may be deflectable to engage and securely couple the first ground shield 180 to the second ground shield 182 when mated thereto.

The right side rails 202 are configured to extend along and follow the paths of the signal contacts 124, such as between the mating end 128 and the mounting end 130 (both shown in FIG. 1) of the electrical connector 102. For example, the right side rails 202 may transition from the mating end 214 to the mounting end 220 and have different segments or portions 228 that are angled relative to each other as the right side rails 202 transition between the ends 214, 220.

For example, the outermost right side rail 202 has a first portion 228*a*, a second portion 228*b* extending from the first portion 228*a* at an angle, a third portion 228*c* extending from the second portion 228*b* at an angle, and a fourth portion 228*d* extending from the third portion 228*c* at an angle. The first portion 228*a* is between the mating portion 210 and the second portion 228*b*. The fourth portion 228*d* is between the mounting portion 216 and the third portion 228*c*. Other portions may be provided in alternative embodiments. Optionally, the connecting strips 206 are provided between the first and second portions 228*a*, 228*b* and between the fourth portion 228*d* and the mounting portion 216; however the connecting strips 206 may be provided at other locations in alternative embodiments.

In the illustrated embodiment, the first portion 228*a* is angled slightly upward, the second portion 228*b* is oriented generally horizontally, the third portion 228*c* is angled downward (for example, at approximately 45°), and the fourth portion 228*d* is oriented generally vertically. Other orientations are possible in alternative embodiments. In an exemplary embodiment, each of the portions 228*a*-228*d* includes side strips 222 and separator strips 224. As such, each of the portions 228*a*-228*d* provides electrical shielding along the right side and along the top of the corresponding signal contact 124. In an exemplary embodiment, the side strips 222 are generally continuous through each of the portions 228*a*-228*d*. The separator strips 224 are generally continuous through each of the portions 228*a*-228*d*; however, slight gaps may be provided at the locations of the connecting strips 206 to allow the connecting strips 206 to be stamped out of the metal blank with the right side rails 202.

Figure 5:
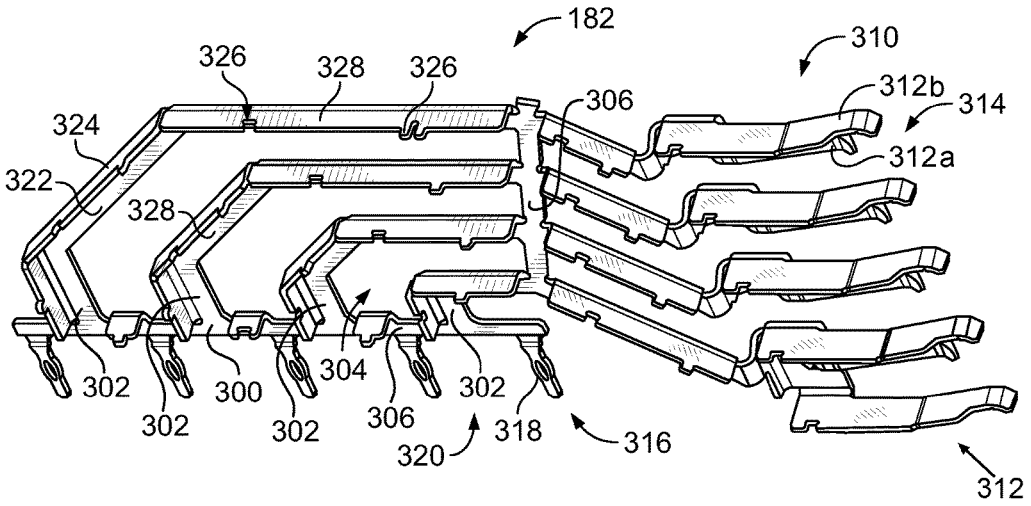
FIG. 5 is a perspective view of a second ground shield of the contact module in accordance with an exemplary embodiment.

FIG. 5 is a perspective view of the second ground shield 182 in accordance with an exemplary embodiment. In an exemplary embodiment, the ground shield 182 is stamped and formed from a stock piece of metal material. The ground shield 182 includes a main body 300 configured to extend along the left side 162 of the dielectric holder 142 (both shown in FIG. 2). The main body 300 may include a plurality of left side rails 302 separated by left side gaps 304, which may be interconnected by connecting strips 306 between the rails 302.

The ground shield 182 includes mating portions 310 defined by mating beams 312 at a mating end 314 of the main body 300. The mating portions 310 are configured to be mated with corresponding mating portions of the mating electrical connector (for example, the C-shaped mating ground shields 114, shown in FIG. 1). In an exemplary embodiment, the ground shield 182 includes side mating beams 312*a* and top mating beams 312*b* configured to extend along the sides and the tops of the corresponding signal contacts 124. The mating beams 312 may be deflectable mating beams, such as spring beams. Optionally, the mating beams 312 are configured to be received inside the corresponding C-shaped mating ground shields 114 of the mating electrical connector 106. Alternatively, the mating beams 312 are configured to extend along the outside of the corresponding C-shaped mating ground shields 114 of the mating electrical connector.

The ground shield 182 includes mounting portions 316 defined by compliant pins 318 at a mounting end 320 of the main body 300. The mounting portions 316 are configured to be terminated to the circuit board 104 (shown in FIG. 1). For example, the mounting portions 316 are configured to be received in plated vias in the circuit board 104.

The left side rails 302 are configured to provide shielding around corresponding signal contacts 124 (shown in FIG. 2). For example, in an exemplary embodiment, the left side rails 302 have side strips 322 configured to extend along the left side 162 of the dielectric holder 142 and separator strips 324 configured to extend into the dielectric holder 142 and extend between corresponding signal contacts 124. The separator strips 324 are bent perpendicular to and extend from the corresponding side strips 322. The left side rails 302 form right angle shielded spaces that receive corresponding signal contacts 124 to provide electrical shielding along the sides of the signal contacts 124 and between the signal contacts 124, such as above and/or below corresponding signal contacts 124. The connecting strips 306 extend between the left side rails 302 to hold the relative positions of the left side rails 302. The left side gaps 304 are defined between the connecting strips 306 and generally follow the paths of the left side rails 302.

In an exemplary embodiment, each separator strip 324 includes a commoning feature 326 for electrically connecting to the first ground shield 180 (shown in FIG. 4). In the illustrated embodiment, the commoning features 326 are commoning tabs extending from the separator strips 324 and commoning slots in the separator strips 324; however, only one type of commoning feature or other types of commoning features may be used in alternative embodiments, such as tabs, spring beams, and the like. The commoning features 326 may be deflectable to engage and securely couple the second ground shield 182 to the first ground shield 180 when mated thereto. Optionally, the commoning features 326 may include a bifurcated clip having first and second deflectable fingers configured to be clipped into corresponding slots.

The left side rails 302 are configured to extend along and follow the paths of the signal contacts 124, such as between the mating end 128 and the mounting end 130 (both shown in FIG. 1) of the electrical connector 102. For example, the left side rails 302 may transition from the mating end 314 to the mounting end 320 and have different segments or portions 328 that are angled relative to each other as the left side rails 302 transition between the ends 314, 320.

Figure 6:
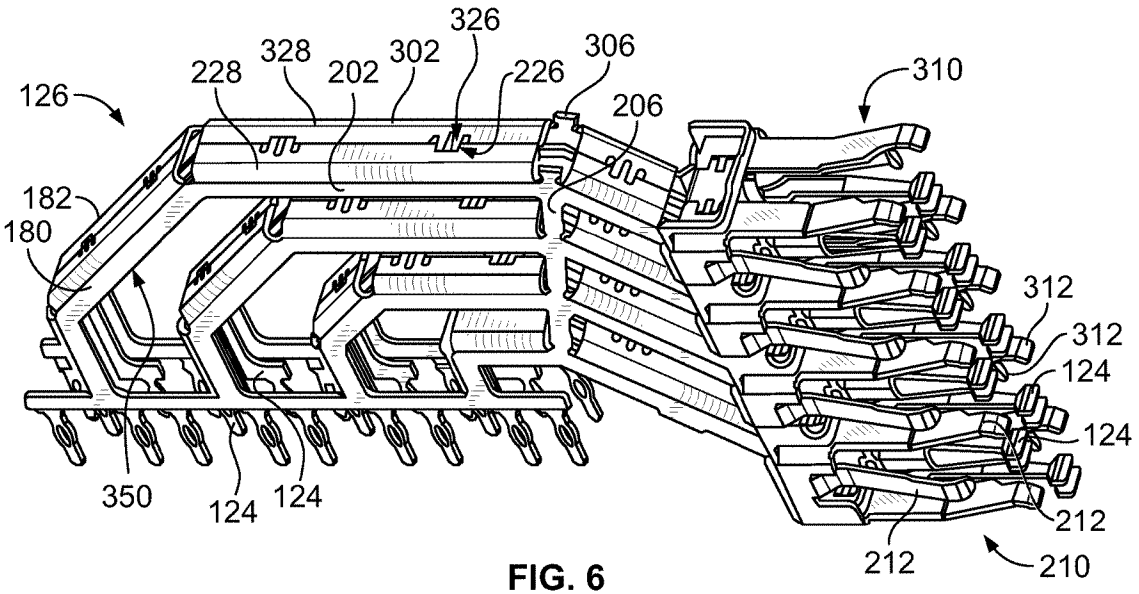
FIG. 6 illustrates a shield structure of the contact module showing the first and second ground shields coupled together.

FIG. 6 illustrates the shield structure 126 showing the first and second ground shields 180, 182 coupled together. The dielectric holder 142 (shown in FIG. 2) is removed for clarity to illustrate the shield structure 126 and the signal contacts 124. The mating portions 210, 310 of the ground shields 180, 182 are configured to be electrically coupled to the mating ground shields 114 (shown in FIG. 1). For example, the mating beams 212, 312 are configured to be received inside the C-shaped area of the mating ground shields 114 and engage the interior surfaces of the walls of the mating ground shields 114.

Figure 7:
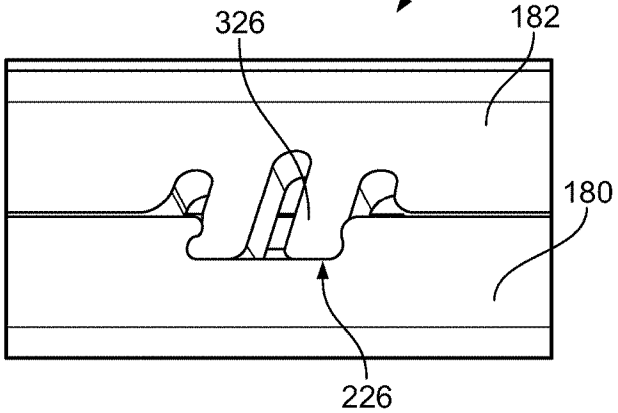
FIG. 7 is an enlarged view of a portion of the shield structure showing commoning features secured together.

The ground shields 180, 182 are mated together during assembly to mechanically and electrically connect the ground shields 180, 182. The commoning features 226, 326 interact to mechanically and electrically connect the ground shields 180, 182. FIG. 7 is an enlarged view of a portion of the shield structure 126 showing the commoning features 226, 326 secured together. The commoning tabs of the commoning feature 226 are received in the commoning slot of the commoning feature 326. The commoning tabs may be deflectable such that the commoning tabs press outward against the commoning feature 326 to secure the ground shields 180, 182 together. For example, the commoning tabs may be bifurcated clips having first and second fingers deflectable toward each other to clip into the commoning slot. The walls defining the commoning slot may be undercut and angled to snapably retain the commoning feature 226 in the commoning feature 326. Returning to FIG. 6, in an exemplary embodiment, each rail 202, 302 includes multiple commoning features 226, 326 to make periodic, reliable electrical connections therebetween. For example, each portion 228, 328 may include at least one commoning feature 226, 326, and in various embodiments may include multiple commoning features 226, 326. Optionally, the commoning features 226, 326 may be provided approximately every 3-5 mm in order to achieve good electrical performance at frequencies targeted at approximately 30-40 GHz; however other spacings may be utilized when targeting performance at different frequencies.

When assembled, the ground shields 180, 182 form C-shaped hoods 350 covering three sides of each pair of signal contacts 124. For example, the hoods 350 cover both the right and left sides as well as the tops of the signal contacts 124 to shield the pair of signal contacts 124 from other pairs of signal contacts 124. The rails 202, 302 of the hood 350 below the pair of signal contacts 124 shield the fourth side of the pair of signal contacts 124 such that the pair is shielded on all four sides. The ground shields 180, 182 thus provide circumferential shielding around the pairs of signal contacts 124. The circumferential shielding is provided around each pair of signal contacts 124 for substantially the entire length of the transition portions 170 (shown in FIG. 2) of the signal contacts. For example, in the illustrated embodiment, the only break in the shielding is provided at the connecting strips 206, 306; however, the short gaps do not detrimentally affect the signal performance, even at high speeds. The ground shields 180, 182 provide shielding in all line-of-sight directions between all adjacent pairs of signal contacts 124, including pairs of signal contacts 124 in adjacent contact modules 122. Optionally, the bottom of the inner-most pair remains unshielded; however, the signal performance of the signal contacts 124 of the inner-most pair remains largely unaffected by having the one side unshielded. Optionally, a shield may be provided at the unshielded side of the inner-most pair.

The stamped and formed ground shields 180, 182 are cost effective to manufacture, as compared to conventional plated plastic conductive holders. The stamped and formed ground shields 180, 182 provide electrical shielding in all directions for each pair-in-row pair of signal contacts 124, as compared to conventional ground shields that only extend along the sides of the signal contacts and not above or below the pair of signal contacts.

Figure 8:
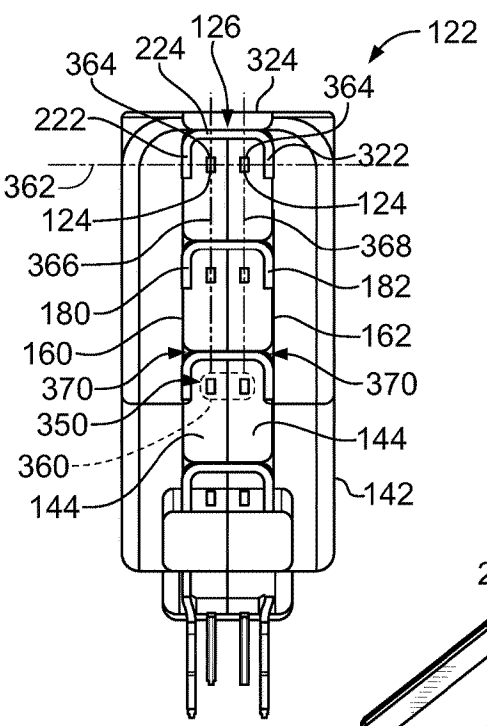
FIG. 8 is a cross sectional view of the contact module.

FIG. 8 is a cross sectional view of one of the contact modules 122. The dielectric bodies 144 hold the corresponding signal contacts 124 and are coupled together to form the dielectric holder 142. The first and second ground shields 180, 182 are coupled to the right and left sides 160, 162, respectively, of the dielectric holder 142. The first and second ground shields 180, 182 provide circumferential shielding around each pair 360 of signal contacts 124. For example, the C-shaped hoods 350 of the shield structure 126 surround the pair-in-row signal contacts 124.

The side strips 222 are provided along a right side of the pairs 360 of signal contacts 124 and are aligned along row axes 362 with the signal contacts 124. The side strips 322 are provided along the left side of the pairs of signal contacts 124 and are aligned along the row axes 362 with the signal contacts 124.

The separator strips 224 extend into shield slots 370 formed in the dielectric holder 142 to extend over tops 364 of the right-side signal contacts 124 of each pair 360 along a right-side column axis 366. The separator strips 324 extend into the shield slots 370 formed in the dielectric holder 142 to extend over the tops 364 of the left-side signal contacts 124 of each pair 360 along a left-side column axis 368. The slots 370 may guide assembly of the first and second ground shields 180, 182 to the dielectric holder 142. The slots 370 may guide the separator strips 224, 324 into engagement with each other.

Figure 9:
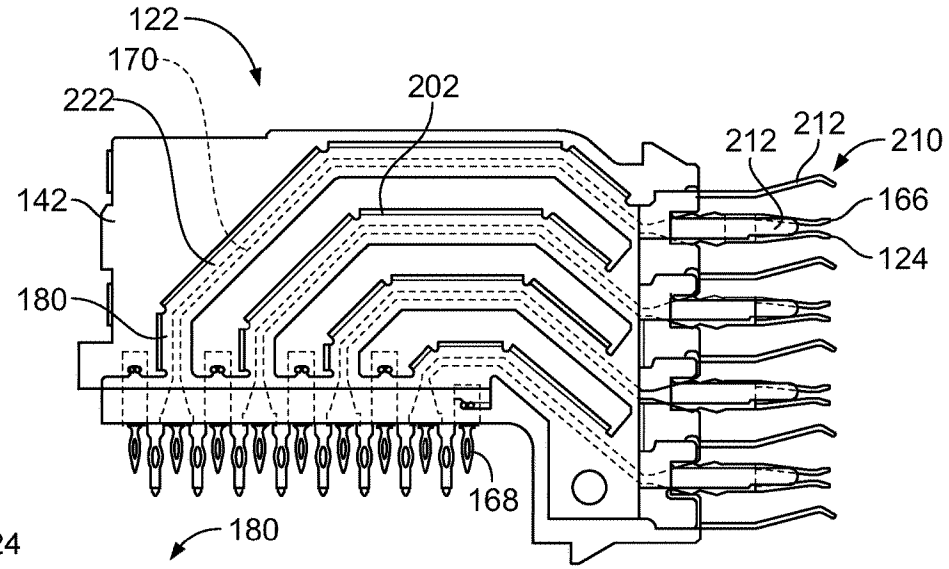
FIG. 9 is a right side view of the contact module in accordance with an exemplary embodiment.

FIG. 9 is a right side view of the contact module 122 in accordance with an exemplary embodiment. FIG. 9 shows the first ground shield 180 coupled to the dielectric holder 142. The side strips 222 are aligned with and follow the paths of the transition portions 170 (shown in phantom) between the mating and mounting portions 166, 168. As such, the right side rails 202 provide electrical shielding along the entire lengths of the transition portions 170 of the signal contacts 124. The mating portions 210 of the first ground shield 180 are aligned with and provide shielding for the mating portions 166 of the signal contacts 124. For example, the mating beams 212 extend along the sides and the top of the mating portions 166.

Figure 10:
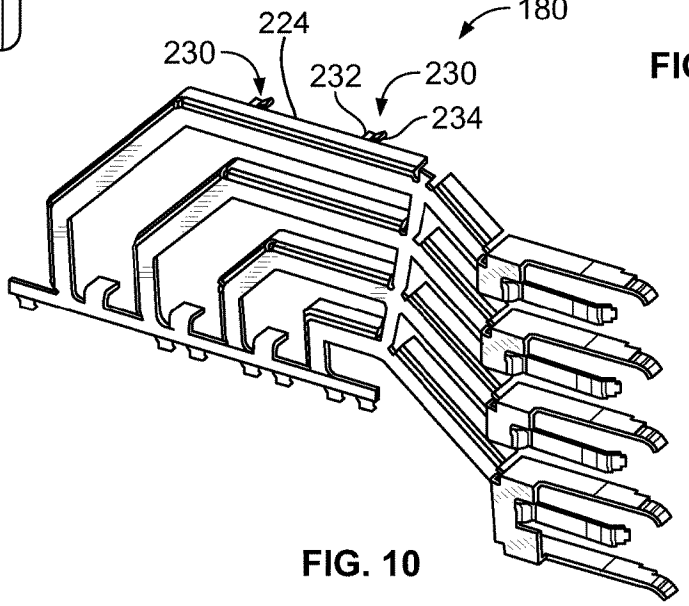
FIG. 10 is a perspective view of the first ground shield in accordance with an exemplary embodiment.

FIG. 10 is a perspective view of the first ground shield 180 in accordance with an exemplary embodiment. The first ground shield 180 is illustrated having a commoning feature 230 similar in function to the commoning feature 226 (shown in FIG. 4) but having a different shape. The commoning feature 230 includes a commoning tab 232 extending from an edge of the separator strip 224. The commoning feature 230 includes a deflectable beam 234 angled upward from the commoning tab 232.

Figure 11:
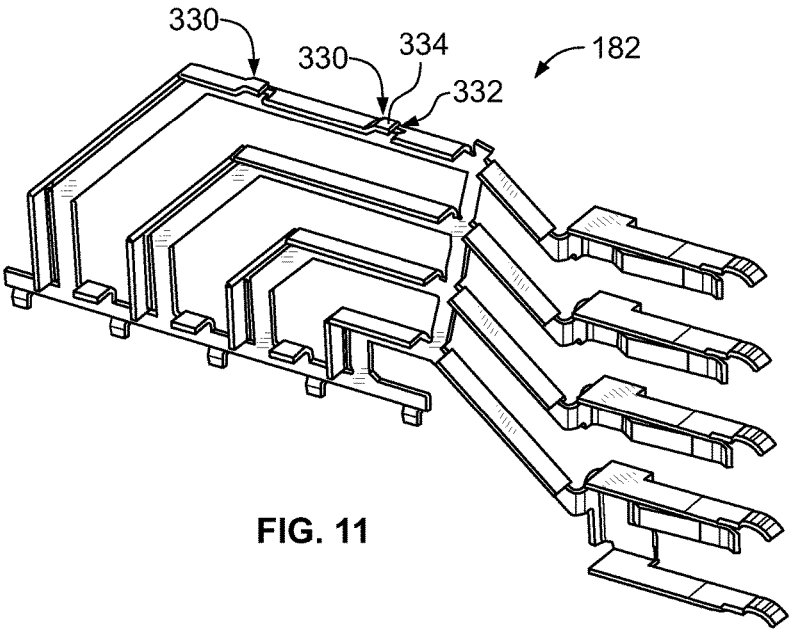
FIG. 11 is a perspective view of the second ground shield in accordance with an exemplary embodiment.

FIG. 11 is a perspective view of the second ground shield 182 in accordance with an exemplary embodiment. The second ground shield 182 is illustrated having a commoning feature 330 similar in function to the commoning feature 326 (shown in FIG. 5) but having a different shape. The commoning feature 330 interfaces with the commoning feature 230 (shown in FIG. 10) to mechanically and electrically connect the ground shields 180, 182.

The commoning feature 330 includes a commoning slot 332 formed in the separator strip 324. The commoning feature 330 includes a deflectable beam 334 angled upward from the separator strip 324. The deflectable beam 334 covers the opening formed with the commoning slot 332 to provide electrical shielding for the commoning slot 332.

Figure 12:
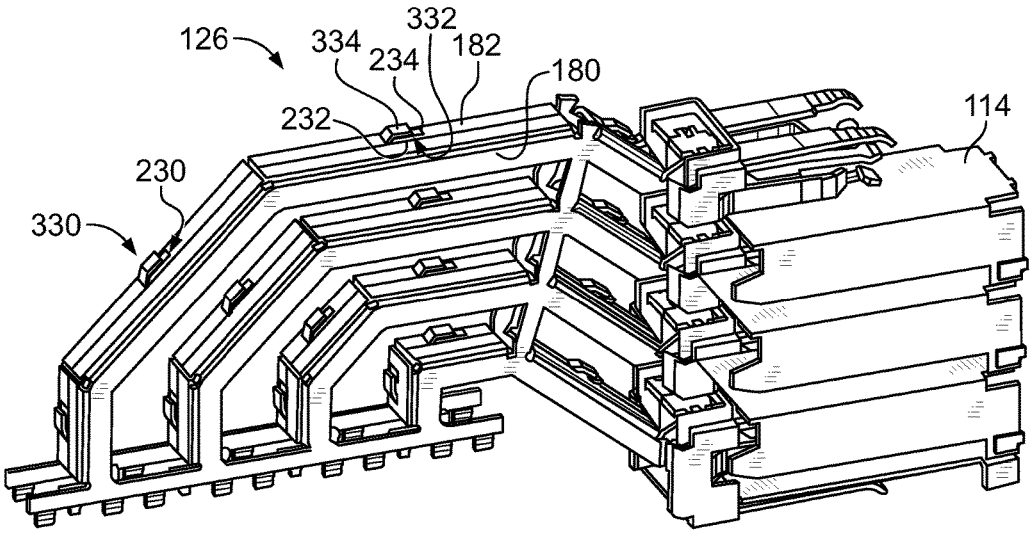
FIG. 12 illustrates the shield structure showing the first and second ground shields shown in FIGS. 10 and 11.

FIG. 12 illustrates the shield structure 126 showing the first and second ground shields 180, 182 coupled together. The ground shields 180, 182 are mated together during assembly to mechanically and electrically connect the ground shields 180, 182. The commoning features 230, 330 interact to mechanically and electrically connect the ground shields 180, 182. The commoning tabs 232 of the ground shield 180 are received in the commoning slots 332 of the ground shield 182. The deflectable beams 234, 334 may engage each other or other portions of the commoning features 230, 330 to mechanically and electrically connect the ground shields 180, 182. The deflectable beam 334 may extend along the top of the separator strip 324.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A contact module comprising:

a dielectric holder having right and left sides extending between a mating end and a mounting end;

signal contacts being held by the dielectric holder, the signal contacts having mating portions extending from the mating end, mounting portions extending from the mounting end for termination to a circuit board, and transition portions extending through the dielectric holder between the mating and mounting portions; and a shield structure coupled to the dielectric holder providing electrical shielding for the signal contacts, the shield structure having a first ground shield provided at the right side of the dielectric holder and a second ground shield provided at the left side of the dielectric holder, the first and second ground shields being electrically connected together between corresponding signal contacts and providing electrical shielding between corresponding signal contacts along a majority of a length of the transition portions, the first ground shield having commoning features directly engaging the second ground shield to electrically connect the first and second ground shields.

2. The contact module of claim 1, wherein the first and second ground shields form C-shaped hoods covering three sides of corresponding signal contacts.

3. The contact module of claim 1, wherein the first and second ground shields provide circumferential shielding around corresponding signal contacts for substantially the entire length of the transition portions through the dielectric holder.

4. The contact module of claim 1, wherein the first ground shield is stamped and formed having the commoning features integral with the first ground shield to electrically common the first and second ground shields.

5. The contact module of claim 1, wherein the first ground shield includes a main body having a plurality of right side rails separated by right side gaps, the right side rails having side strips extending along the right side of the dielectric holder, the right side rails having separator strips extending into the dielectric holder and disposed between corresponding signal contacts, and wherein the second ground shield has a main body having a plurality of left side rails separated by left side gaps, the left side rails having side strips extending along the left side of the dielectric holder, the left side rails having separator strips extending into the dielectric holder and disposed between corresponding signal contacts, wherein the separator strips of the right side rails engage and are electrically connected to corresponding separator strips of the left side rails, and wherein the side strips of the right side rails are aligned with corresponding side strips of the left side rails on opposite sides of the corresponding signal contacts and the gaps between the side strips are offset at least one of above and below the corresponding signal contacts.

6. The contact module of claim 5, wherein the first ground shield is stamped and formed having the separator strips bent perpendicular to and extending from the corresponding side strips, and wherein the second ground shield is stamped and formed having the separator strips bent perpendicular to and extending from the corresponding side strips.

7. The contact module of claim 5, wherein the main body of the first ground shield includes connecting strips between the right side rails to hold the relative positions of the right side rails, the right side gaps being defined between the connecting strips of the main body of the first ground shield, and wherein the main body of the second ground shield includes connecting strips between the left side rails to hold the relative positions of the left side rails, the left side gaps being defined between the connecting strips of the main body of the second ground shield.

8. The contact module of claim 5, wherein the separator strips of the right side rails are bent perpendicular to the corresponding side strips of the right side rails, and wherein the separator strips of the left side rails are bent perpendicular to the corresponding side strips of the left side rails.

9. The contact module of claim 5, wherein the signal contacts are arranged in pairs, each right side rail provides electrical shielding along the right side and a top of one of the signal contacts of the corresponding pair of signal contacts and each left side rail provides electrical shielding along the left side and a top of another of the signal contacts of the corresponding pair.

10. The contact module of claim 5, wherein each separator strip of the first ground shield includes a commoning tab and each separator strip of the second ground shield includes a commoning slot receiving the corresponding commoning tab to electrically common the first and second ground shields.

11. The contact module of claim 5, wherein the first ground shield includes a plurality of mating portions at a mating end of the first ground shield, the mating portions having mating beams along the right side and a top of the corresponding signal contact, and wherein the second ground shield includes a plurality of mating portions at a mating end of the second ground shield, the mating portions having mating beams along the left side and the top of the corresponding signal contact.

12. The contact module of claim 5, wherein a first of the right side rails has a first portion and a second portion extending from the first portion at an angle, the side strips being continuous through the first and second portions, the separator strips being continuous through the first and second portions, and wherein a first of the left side rails has a first portion and a second portion extending from the first portion at an angle, the side strips being continuous through the first and second portions, the separator strips being continuous through the first and second portions.

13. A shield structure for a contact module having a dielectric holder holding signal contacts, the shield structure comprising:

a first ground shield configured to extend along a right side of the dielectric holder, the first ground shield having a main body having a plurality of right side rails separated by right side gaps, the right side rails having side strips configured to extend along the right side of the dielectric holder, the right side rails having separator strips configured to extend into the dielectric holder and extend between corresponding signal contacts; and a second ground shield configured to extend along a left side of the dielectric holder, the second ground shield having a main body having a plurality of left side rails separated by left side gaps, the left side rails having side strips configured to extend along the left side of the dielectric holder, the left side rails having separator strips configured to extend into the dielectric holder and extend between corresponding signal contacts;

wherein the separator strips of the right side rails include commoning features directly engaging and being electrically connected to corresponding separator strips of the left side rails; and wherein the side strips of the right side rails are aligned with corresponding side strips of the left side rails on opposite sides of the corresponding signal contact and the gaps between the side strips are offset at least one of above and below the corresponding signal contact.

14. The shield structure of claim 13, wherein the first ground shield is stamped and formed having the separator strips bent perpendicular to and extending from the corresponding side strips, and wherein the second ground shield is stamped and formed having the separator strips bent perpendicular to and extending from the corresponding side strips to directly engage the separator strips of the first and second ground shields.

15. The shield structure of claim 13, wherein the main body of the first ground shield includes connecting strips between the right side rails to hold the relative positions of the right side rails, the right side gaps being defined between the connecting strips of the main body of the first ground shield, and wherein the main body of the second ground shield includes connecting strips between the left side rails to hold the relative positions of the left side rails, the left side gaps being defined between the connecting strips of the main body of the second ground shield.

16. The shield structure of claim 13, wherein the separator strips of the right side rails are bent perpendicular to the corresponding side strips of the right side rails, and wherein the separator strips of the left side rails are bent perpendicular to the corresponding side strips of the left side rails.

17. The shield structure of claim 13, wherein the signal contacts are arranged in pairs, each right side rail provides electrical shielding along the right side and a top of one of the signal contacts of the corresponding pair and each left side rail provides electrical shielding along the left side and a top of another of the signal contacts of the corresponding pair.

18. The shield structure of claim 13, wherein each separator strip of the first ground shield includes a commoning tab and each separator strip of the second ground shield includes a commoning slot receiving the corresponding commoning tab to electrically common the first and second ground shields.

19. The shield structure of claim 13, wherein the first ground shield includes a plurality of mating portions at a mating end of the first ground shield, the mating portions having mating beams along the right side and a top of the corresponding signal contact, and wherein the second ground shield includes a plurality of mating portions at a mating end of the second ground shield, the mating portions having mating beams along the left side and the top of the corresponding signal contact.

20. An electrical connector comprising:

a housing having a mating end, contact modules arranged in a contact module stack received in and extending from the housing for termination to a circuit board;

wherein each contact module comprises:

a dielectric holder having right and left sides extending between a mating end and a mounting end;

signal contacts being held by the dielectric holder, the signal contacts having mating portions extending from the mating end, mounting portions extending from the mounting end for termination to a circuit board, and transition portions extending through the dielectric holder between the mating and mounting portions; and a shield structure coupled to the dielectric holder providing electrical shielding for the signal contacts, the shield structure having a first ground shield provided at the right side of the dielectric holder and a second ground shield provided at the left side of the dielectric holder, the first and second ground shields being electrically connected together between corresponding signal contacts and providing electrical shielding between corresponding signal contacts along a majority of a length of the transition portions, the first ground shield having commoning features directly engaging the second ground shield to electrically connect the first and second ground shields, the first ground shield includes a plurality of mating portions at a mating end of the first ground shield, the mating portions having mating beams along a right side and a top of the mating portions of the corresponding signal contacts, and wherein the second ground shield includes a plurality of mating portions at a mating end of the second ground shield, the mating portions having mating beams along a left side and a top of the mating portions of the corresponding signal contacts.

* * * * *